United States Patent [19]

Schneider et al.

[11] Patent Number: 4,614,505

[45] Date of Patent: Sep. 30, 1986

[54] TRANSFORMABLE TOY FIGURE

[75] Inventors: Thomas P. Schneider, Westlake; Susan E. Trentel, Lakewood, both of Ohio

[73] Assignee: Those Characters from Cleveland, Cleveland, Ohio

[21] Appl. No.: 754,142

[22] Filed: Jun. 27, 1985

[51] Int. Cl.[4] ..... A63H 3/02

[52] U.S. Cl. ..... 446/372; 446/321; 446/369

[58] Field of Search ..... 446/72, 73, 74, 26, 446/321, 327, 369, 372; 5/413

[56] References Cited

U.S. PATENT DOCUMENTS

| | | | |
|---|---|---|---|
| D. 174,238 | 3/1955 | Stevens | D2/25 |
| D. 217,368 | 4/1970 | Klamer . | |
| D. 273,028 | 3/1984 | Finney . | |
| 820,027 | 5/1906 | Richardson | 446/73 X |
| 1,396,766 | 11/1921 | McClelland . | |
| 1,437,467 | 12/1922 | Dykman . | |
| 2,274,303 | 2/1942 | Ornstein . | |
| 2,325,750 | 8/1943 | DeVries . | |
| 2,852,885 | 9/1958 | Mayer | 446/72 X |
| 3,226,849 | 1/1966 | Rosen | 446/26 X |
| 3,789,546 | 2/1974 | Morrison . | |
| 3,820,276 | 6/1974 | Goldfarb | 446/327 |
| 3,831,316 | 8/1974 | Weistrop . | |
| 3,864,871 | 2/1975 | Kaelin . | |
| 4,236,263 | 12/1980 | Allee . | |
| 4,304,065 | 12/1981 | Baiera | 446/327 |
| 4,336,665 | 6/1982 | Moreau . | |
| 4,413,442 | 11/1983 | McSweeney . | |
| 4,505,687 | 3/1984 | Munro . | |
| 4,543,669 | 10/1985 | Katz | 446/369 |
| 4,563,159 | 1/1986 | Hills et al. | 446/74 |

*Primary Examiner*—F. Barry Shay

*Attorney, Agent, or Firm*—Renner, Otto, Boisselle & Lyon

[57] ABSTRACT

A toy figure which is progressively transformable into different configurations. The figure has a body portion comprising a mass of compliant fill material with a fabric cover thereover. The body portion has fanciful material (e.g. facial components and appendages) integral therewith. A fabric segment is secured to the body portion and forms a pocket on the body portion. The pocket is resiliently deformable to allow parts of the body portion and its fanciful material to be forced through the pocket as the toy is changed from one configuration to another. The pocket has a memory and, when a desired transformation is achieved, the pocket is contractable to hold the figure in a new configuration. The top figure preferably depicts a fanciful three dimensional character in one of its basic configurations and is transformed into a ball-like form in another of its basic configurations. When the figure is in its ball-like form, some of the fanciful material is visible to give the ball-like form a fanciful appearance.

26 Claims, 19 Drawing Figures

BACK PIECE

TRANSFORMABLE TOY FIGURE

INTRODUCTION

The present application relates to a toy figure which can be progressively transformed (changed) into different configurations. It relates particularly to a toy figure with a specially formed pocket that is resiliently deformed to allow the toy figure to be progressively transformed into different configurations.

BACKGROUND

Toy figures that can be changed from one configuration to another have been suggested in the past. One such toy figure is shown in U.S. Pat. No. 4,413,442. The patent discloses a toy figure that can be changed from one discrete configuration (e.g., an egg) to another discrete configuration (e.g., an animal such as a duck). The toy is changed by folding back the outer covering of the egg and pushing the body portion of the animal through an opening in the egg covering. The portion of the covering that has been folded back is then locked in place by Velcro strips to maintain the figure in the configuration of an animal. The patentee indicates that the foregoing type of transformation is designed to serve an educational function by depicting to a child the transformation from an egg to a related animal.

Other types of changeable toy figures are shown in U.S. Pat. Nos. 1,396,776; 2,195,127; and 4,336,665. In U.S. Pat. No. 4,336,665, a stuffed toy figure has a body portion with two heads connected to each other, and a skirt which carries the toy's appendages. The skirt is inverted between one of two discrete positions to cover one head portion and expose the other head portion. The appendages carried by the skirt form the apendages associated with either of the head portions. In U.S. Pat. Nos. 1,396,766 and 2,195,127, there are also a pair of head portions connected to each other, and each head portion has at least some appendages also connected to it. A skirt, which does not carry appendages, is inverted between the head portions to cover one head portion and its associated appendages, and to expose the head portion and its associated appendages.

Finally, there are currently on the market toys known as "transformers", "go-bots", etc., which comprise mechanical elements that are manipulated to transform the toys between different configurations (e.g. between robots and vehicles).

SUMMARY OF THE INVENTION

The present invention relates to a transformable toy figure with a unique structure for progressively transforming the toy figure between different configurations.

The toy figure of the present invention has a body portion with fanciful material thereon and a special fabric segment secured thereto. The special fabric segment defines a pocket on the figure. The pocket can be resiliently (elastically) deformed to allow the figure to be progressively transformed from one configuration to another. The pocket has a memory which enables it to hold the figure in a selected configuration.

The resiliently deformable pocket has a resiliently deformable opening through which selected portions of the body portion can be forced during transformation of the figure from one configuration to another. The pocket's memory normally tends to contract the size of the opening toward a predetermined set. The pocket is resiliently expandable as the figure is transformed from one configuration to another. When a desired transformation is achieved, the pocket is allowed to contract to maintain the figure in its transformed configuration.

In a first basic configuration of the toy, the body portion has fanciful material (preferably appendages and facial components) integral therewith. The special fabric segment is connected with the body portion in such a way that in the first configuration, the pocket and the fanciful material are displayed in separate locations on the outer periphery of the body portion. In a second basic configuration, the pocket is inverted, and surrounds a selected part of the body portion and its fanciful material. In the preferred embodiment, when the figure is in its second configuration, it has a ball-like form, with some of the fanciful material at least partly visible and giving the ball-like form a fanciful appearance.

The toy figure of the invention has two basic modes of transformation between its basic first and second configurations. In one mode of transformation, the pocket is resiliently deformed to progressively cover a portion of the fanciful material on the body portion as the figure is transformed from its first configuration to its second configuration. In another mode of transformation, the pocket is resiliently deformed to progressively uncover the fanciful material on the body portion as the figure is transformed from its second configuration to its first configuration.

Due to the memory of the pocket, the toy figure can be maintained in a variety of intermediate configurations during either of its first or second modes of transformation. During either mode of transformation, if the forces causing the deformation are removed, and the pocket is allowed to contract under its memory, the figure will assume a configuration determined primarily by the amount of the body portion and its fanciful material that is enclosed (covered) by the pocket.

With the toy figure according to the preferred embodiment, at least some of the fanciful material on the body portion is visible in all of the different configurations of the toy, and contributes to the fanciful look of the toy in each configuration. The pocket is resiliently deformable to allow transformation of the figure from one configuration to another, and its memory enables the pocket to hold the figure in different configurations as the toy figure is transformed between its first and second basic configurations.

Other features of the present invention will be further apparent from the following detailed description and the annexed drawings.

DESCRIPTION OF THE DRAWINGS

FIGS. 5A–5L schematically illustrate different fabric pattern pieces for forming a transformable toy figure according to the principles of the present invention.

DETAILED DESCRIPTION OF THE PREFERRED EMBODIMENT

The principles of the present invention are particularly useful in forming a stuffed toy figure. The invention is described below in connection with a stuffed toy figure.

A stuffed toy figure according to the present invention can be transformed between distinctly different basic configurations. In one basic configuration (FIG. 1) the stuffed toy figure has fanciful material which may include facial components (eyes, ears, nose, mouth) and appendages (tail, arms, legs) which give the toy figure the appearance of a fanciful character. In another basic configuration (FIG. 2) the stuffed toy figure has a ball-like form, with some of the fanciful material (e.g. eyes) visible thereon. The toy is transformed between its basic configurations by deforming a specially formed pocket on the figure.

Figure 1:
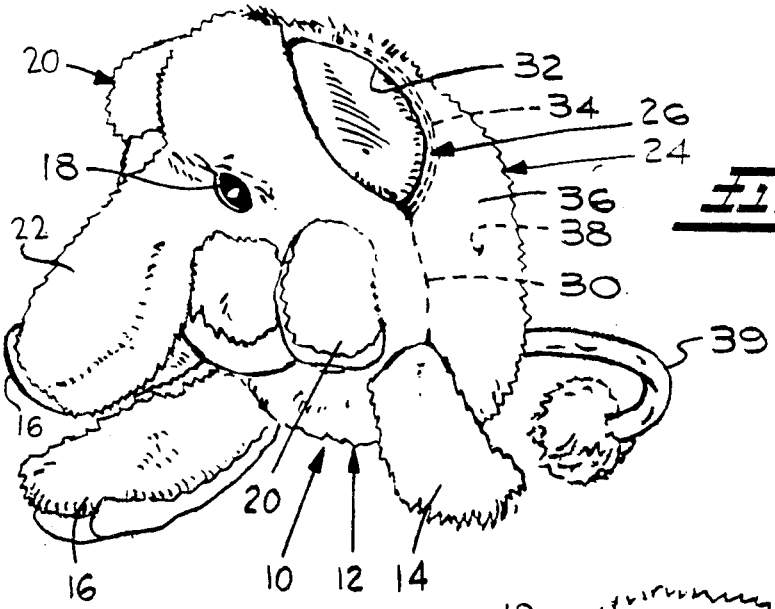
FIG. 1 is a three dimensional view of a transformable toy figure according to the invention, in one of its basic configurations.

Referring to FIG. 1, the stuffed toy figure has a body portion 10 comprising a fabric cover 12 with a soft, compliant fill material therein. The fabric cover can be any commercially available material for forming stuffed toy figures (e.g. plush pile). The fill material may be made of a suitable, commercially available fill material (e.g. fiber fill, polyurethane, etc.).

The body portion 10 has a series of appendages and facial components integral therewith. The appendages include legs 14 and arms 16. The facial components include eyes 18, ears 20, and a nose 22.

The stuffed toy figure also has a special fabric segment 24 connected to the body portion 10. The fabric segment 24 is preferably sewn to the fabric cover 12 and forms a pocket 26 on the body portion 10. The pocket 26 includes an opening 32, described more fully hereinafter.

When the figure is in the configuration of FIG. 1, the pocket 26 and the fanciful material are displayed at different locations on the outer periphery of the body portion 10. When the figure is in the ball-like form of FIG. 2, the pocket 26 encloses a substantial part of the body portion and its fanciful material, but leaves at least some of the fanciful material visible to give the ball-like form a fanciful appearance.

In this application, reference to a "resiliently deformable" pocket means a pocket with the capability to expand resiliently (elastically), particularly in the area defining the opening in the pocket, due to characteristics such as:

a. a partially tensioned length (or piece) of elastic fixed (sewn) to the fabric in the area of the opening;
b. the fabric itself being resiliently (elastically) expandable, such as for example:
   (i) the fabric comprising resiliently deformable fibers;
   (ii) the fabric being in a woven pattern that allows it to expand and contract resiliently; and
c. combinations of the foregoing.

According to the preferred embodiment, the resiliently deformable pocket 26 is formed by a fabric segment 24 whose fibers have inherent resiliency, and a partially tensioned length of elastic sewn to the fabric segment in the area of the opening 32. More specifically, the fabric segment 24 is preferably a piece of compliant, napped knit fabric material, which can stretch elastically and which has its own memory. Suitable materials for the fabric segment 24 are napped knit plush pile and Velour. The fabric segment 24 is secured, preferably sewn, to the fabric cover 12 along a seam shown at 30 in FIG. 1 in order to form the pocket 26. An unsewn length of the fabric segment 24 defines the opening 32 in the pocket 26.

The length or piece of elastic is shown at 34 in the figures. The length of elastic is preferably sewn to the fabric segment 24, along the length of the fabric segment which defines the opening 32 in the pocket 26. The length of elastic 34 is sewn to the fabric while the length of elastic is under a state of tension (elongation), and when the external source of tension is removed, the elastic contracts the size of the opening 32 somewhat, but the fabric maintains the piece of elastic in a partially tensioned state. The partially tensioned piece of elastic helps provide the pocket with its memory, tending to contract the size of the opening in the pocket toward a predetermined set in which the size of the opening 32 is as small as possible. The pocket, particularly in the area of the opening 32, is resiliently deformable to expand the size of the opening 32 during transformation of the figure from one configuration (e.g. the configuration of FIG. 1) to another configuration (e.g. the configuration of FIG. 2).

In the configuration of FIG. 1, the toy stuffed figure depicts a fanciful character, with the pocket 26 located on the back of the character. The appendages and the facial components of the figure are completely exposed, and the pocket 26 is contracted to form a segment of the character's back. The surface 36 of the fabric segment 24 on the outside of the pocket 26 forms part of the outer periphery of the figure. The other surface 38 of the fabric segment is disposed on the inside of the pocket 26 and is not visible when the toy figure is in the configuration of FIG. 1. The tail 39 of the character is connected to the surface 36 of the fabric segment 24, and the tail 39 is located at the end of the pocket 26 remote from the opening 32 in the pocket 26.

Figure 2:
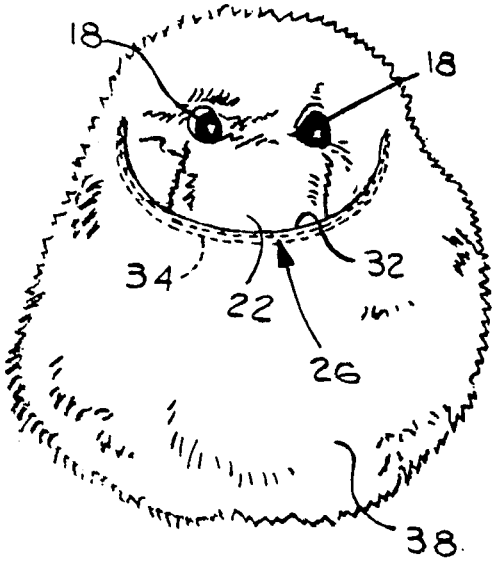
FIG. 2 is a three dimensional view of the transformable toy figure of the invention, in another one of its basic configurations.

In transforming the toy stuffed figure from the configuration of FIG. 1 to the configuration of FIG. 2, the pocket 26, paricularly the opening 32, is expanded, and the body portion 10, its attached appendages and facial components, are forced through the opening 32. The pocket 26 is inverted, so that it progressively encloses the body portion and the appendages, and partially encloses some of the facial components. During this transformation, if it is desired to maintain the figure in a new configuration, the fabric segment 24 is allowed to contract, in accordance with its memory, to maintain the new geometry of the figure. For example, when the figure is transformed to the ball-like form of FIG. 2, the fabric segment 24 is allowed to contract to maintain the figure in the ball-like form, with the eyes and part of the nose visible on the outer periphery of the new figure. This gives the ball-like form of FIG. 2 its own fanciful appearance.

The manner in which the stuffed toy figure is transformed from the configuration of FIG. 1 to the configuration of FIG. 2 is more specifically shown in FIGS. 4A–4D. The body portion 10 and the end of the pocket 26 carrying the tail 39 are forced upward through the opening 32 in the pocket 26, and the pocket is progressively inverted (see FIGS. 4B and 4C). This results in the body portion and its attached appendages being forced upwardly through the opening 32, and also in the pocket 26 being inverted to cover the tail 39, the appendages and a portion of the facial components (see FIGS. 4C and 4D). The figure will now have a ball-like form with portions of the facial components (i.e., the eyes and part of the nose) still visible on the outer periphery of the new figure. During this transformation, the surfaces of the pocket are inverted, so that the surface 38 of the fabric segment 24 now defines part of the outer periphery of the figure in the configuration of FIG. 2. When the pocket 26 is allowed to contract, it will surround a substantial part (i.e., more than 50%) of the body portion 10 of the figure, and will maintain the figure in its ball-like form. The partly covered nose and exposed eyes will give the ball-like form a unique fanciful appearance.

Figure 3:
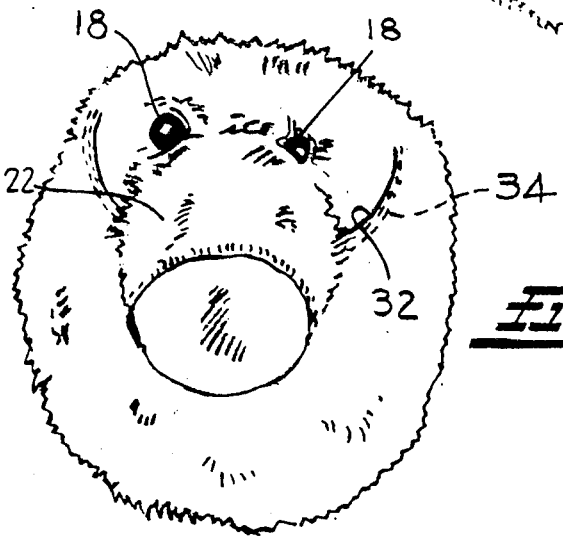
FIG. 3 is a three dimensional view of the transformable toy figure of the invention, in an intermediate configuration.
Figure 4A:
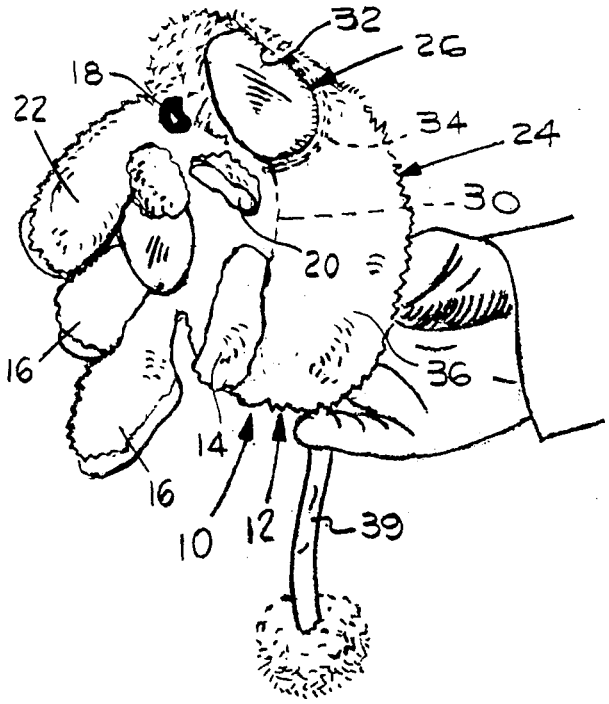
FIGS. 4A–4D schematically illustrate the manner in which the transformable toy figure of the invention is transformed between two of its configurations.
Figure 4B:
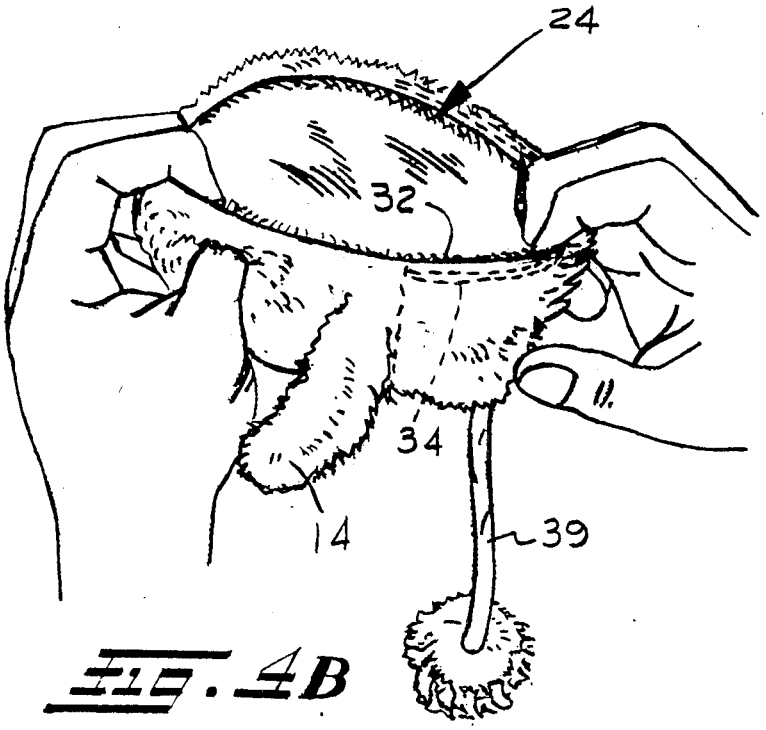
Figure 4C:
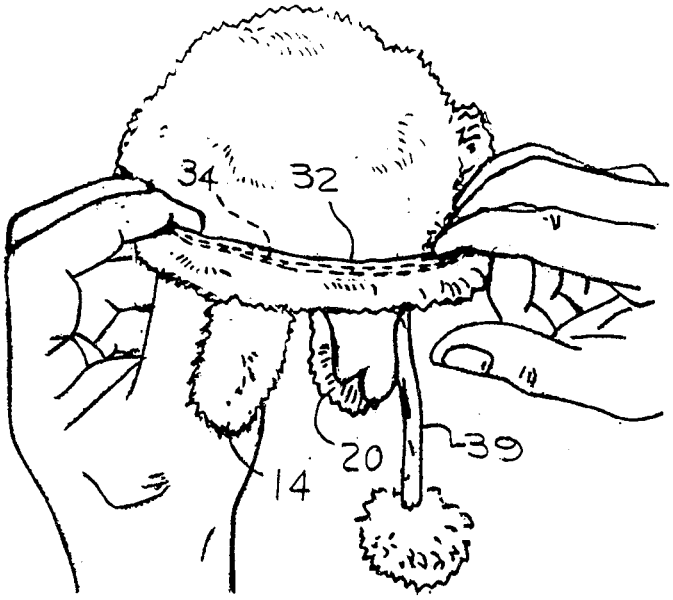
Figure 4D:
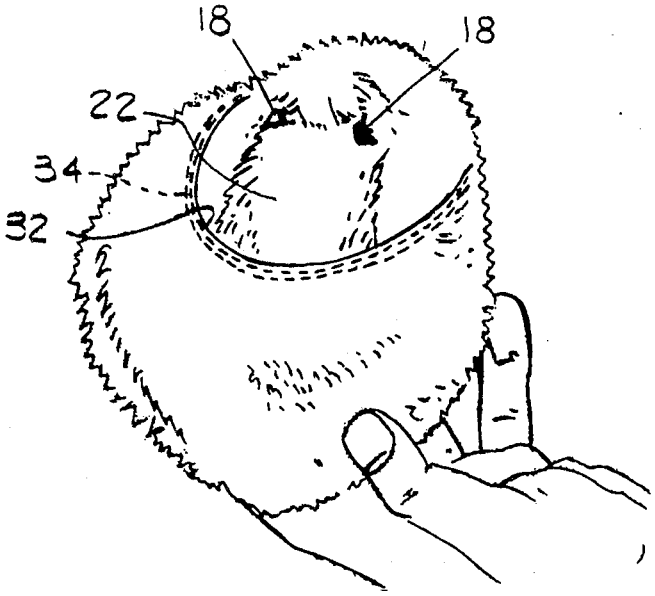

When the stuffed toy figure is in its ball-like form, it can be further transformed between different fanciful configurations while still maintaining its basic ball-like appearance. For example, the figure can be readily changed from the configuration of FIG. 2 to the configuration of FIG. 3 by simply forcing the character's nose completely outside opening 32 in the pocket 26. The opening 32 in the pocket 26 will readily deform resiliently to allow that transformation, and the pocket, when allowed to contract, will maintain the figure in the configuration of FIG. 3. Similarly, the figure can be further modified, by deforming the pocket, especially the opening 32, to progressively uncover other portions of the facial components and/or the appendages, and then allowing the pocket 26 to contract when the figure is in a desired form.

The fabric pieces which can be used to form a fanciful character as depicted by the figures are shown in FIGS. 5A–5L. Preferably, a front piece (FIG. 5A), a tummy piece (FIG. 5B), and a back piece (FIG. 5L) which is slightly larger then the front piece, are sewn together to form the body portion of the figure. Separate fabric pieces are used to form the appendages, the facial components and the tail of the character (see FIGS. 5C–5J). A separate fabric piece (FIG. 5K) is used to form the special fabric segment 24.

Figure 5A:
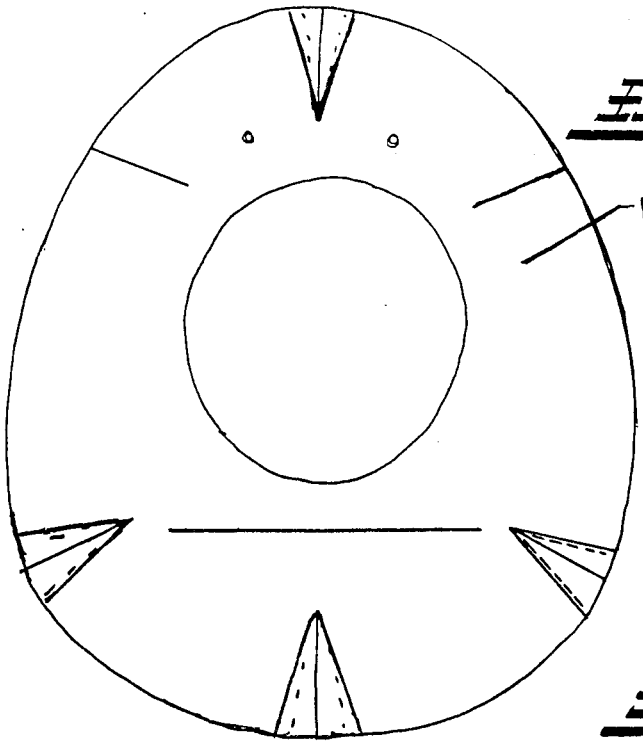
Figure 5D:
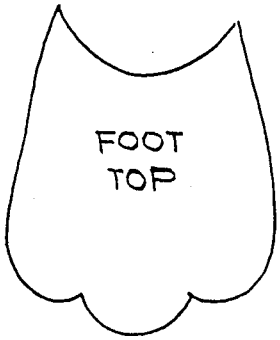
Figure 5E:
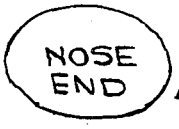
Figure 5B:
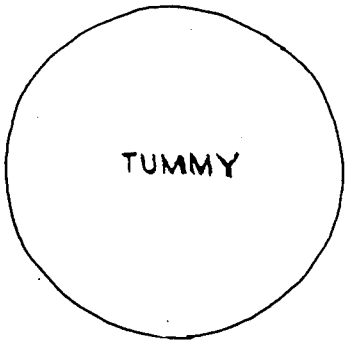
Figure 5F:
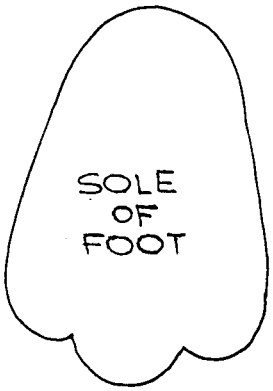
Figure 5G:
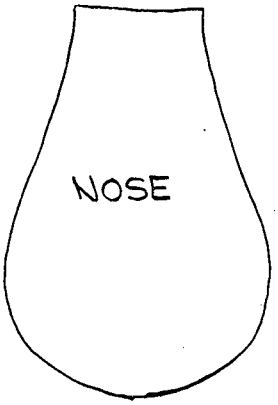
Figure 5C:
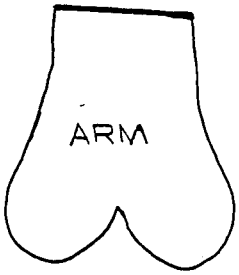
Figure 5H:
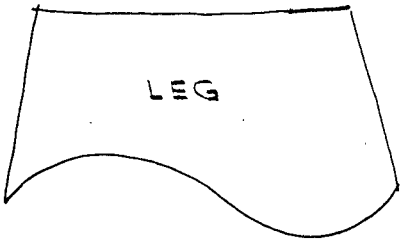
Figure 5I:
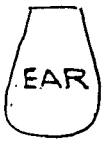
Figure 5J:
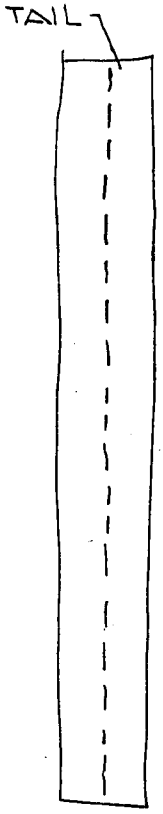
Figure 5K:
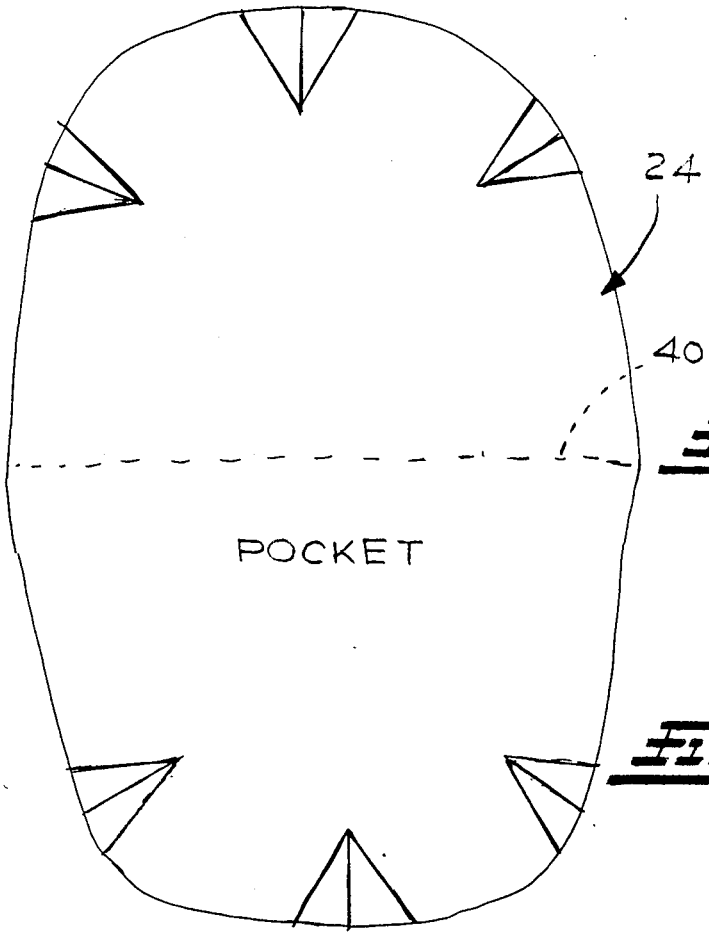
Figure 51:
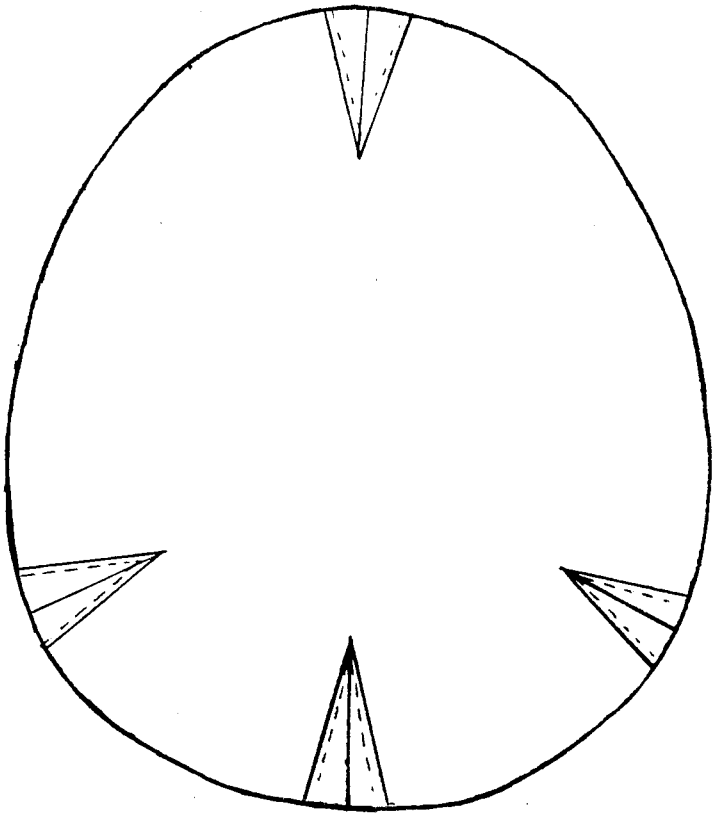

The fabric segment 24 is preferably a folded over piece of fabric with the length of elastic sewn to a seam 40 on the fold line of the fabric piece (see FIG. 5K). The fabric segment 24 should be large enough (in surface area) in relation to the body portion 10 of the figure so that the pocket will have sufficient volume to enclose a substantial part of the body portion 10 when the figure is in its ball-like form.

With a toy figure constructed according to the principles of the invention, there are many configurations the figure can be formed into during progressive transformation of the figure between the configuration of FIG. 1 and the configuration of FIG. 2. The transformation can be stopped at almost any point and, by allowing the pocket to contract, the pocket will hold the figure in its new configuration.

The preferred form of the invention provides a figure in which the fanciful material comprises facial components, and at least some of the facial components are displayed on the outer geometry of the figure when the figure is in its ball-like form. However, it is contemplated that the principles of the invention would be applicable to form a figure whose fanciful material comprises something other than facial components. Further, the principles of this invention may also be used to form a figure in which the resiliently deformable pocket encloses all of the fanciful material on the body portion when the figure is in its ball-like form. With the latter type of figure, the ball-like form might not have the same fanciful appearance as the figure of the preferred embodiment. However, the resiliency and the memory of the pocket would still allow the figure to have the same modes of progressive transformation described above in connection with the preferred embodiment, and the figure can be placed in different fanciful configurations during either mode of transformation.

Furthermore, it is contemplated that the fabric segment forming the pocket could itself have some fanciful material on either of its opposite sides, in order to form part of the fanciful appearance of the figure in any of its configurations.

Also, while the preferred form of the body portion 10 is a soft stuffed material, it is also contemplated that the the body portion can be made of other materials (e.g. vinyl). In the case of a vinyl body portion, the body portion would not necessarily be stuffed. However, the pocket would still be made from a resiliently deformable segment of napped knit fabric (e.g. plush pile) that is secured to the body portion.

Thus, with the concepts of the present invention, it is possible to form fanciful stuffed figures that are readily transformed into different configurations. With the foregoing disclosure in mind, the manner in which the principles of the invention can be applied to form all sorts of fanciful changeable figures will be readily apparent to those of ordinary skill in the art.

What is claimed is:

1. A toy figure which is transformable between first and second configurations, comprising a body portion having fanciful material integral therewith, and means enabling transformation of the toy figure between its first and second configurations comprising a fabric segment integral with said body portion and forming a pocket thereon; said pocket having an opening; said pocket being resiliently deformable and having a memory which contracts the pocket toward a predetermined set when forces causing deformation of the pocket are removed; said pocket being resiliently deformable to expand the size of the pocket as the toy figure is transformed from one configuration to another; the fabric segment having first and second surfaces; the pocket being inverted as said toy figure is transformed between its first and second configurations such that (i) one of the first and second surfaces of the fabric segment is maintained in facing relation to and at least partially against a part of the body portion and the other surface defines part of the outer periphery of the figure when the figure is in its first configuration and (ii) the other of the first and second surfaces of the fabric segment is maintained in facing relation to and at least partially against a part of the body portion and the one surface defines part of the outer periphery of the figure when the figure is in its second configuration; said pocket being resiliently deformable to progressively uncover said fanciful material in a first mode of transformation of the toy figure between said first and second configurations; said pocket being resiliently deformable to progressively cover said fanciful material in a second mode of transformation of the toy figure between said first and second configurations; the memory of the pocket enabling the pocket to hold the toy figure in a selected configuration during either of said first or second modes of transformation of the toy figure.

2. A toy figure as defined in claim 1, wherein said fabric segment and said body portion cooperate to define the opening in said pocket, said body portion and said fabric segment being configured such that said body portion passes through the opening as the figure is transformed between its first and second configurations.

3. A toy figure as defined in claim 2, wherein at least some of the fanciful material integral with the body portion forms part of the outer periphery of the figure in each of its first and second configurations.

4. A toy figure as defined in claim 3, wherein said fanciful material comprises facial material integral with said body portion, said facial material and said pocket being disposed at different locations on the body portion when the figure is in said first configuration, said pocket covering at least part of the body portion and the facial material and causing the figure to have a ball-like form when the figure is in said second configuration, at least some of the facial material on the body portion defining part of the outer periphery of the toy figure when the toy figure is in its ball-like form, to give the toy figure a fanciful appearance when the figure is in its ball-like form.

5. A toy figure as defined in claim 4 wherein the facial material includes an eye portion connected with the body portion, said eye portion being at least partly visible when the figure is in its ball-like form.

6. A toy figure as defined in claim 4 wherein a partially tensioned length of elastic is connected with said fabric segment in the area of said opening of said pocket, said partially tensioned length of elastic biasing the opening in the pocket in a manner tending to contract the opening toward a predetermined set, said partially tensioned length of elastic allowing the opening in said pocket to expand resiliently during transformation of the figure from one configuration to another.

7. A toy figure as defined in claim 6 wherein said body portion comprises a mass of compliant fill material with a compliant fabric cover thereover.

8. A toy figure as defined in claim 7, wherein said fanciful material comprises appendages integral with said body portion, said pocket being resiliently expandable to cover a selected part of said body portion and its appendages when said figure is in its ball-like form.

9. A toy figure as defined in any of claims 6, 7 or 8 wherein said fabric segment comprises a segment of resiliently deformable fiber material secured to said body portion.

10. A toy figure as defined in claim 2, wherein said pocket is resiliently expandable to cover a selected portion of said body portion and its fanciful material and to give the figure a ball-like form when said figure is in said second configuration.

11. A toy figure as defined in claim 10 wherein a partially tensioned length of elastic is connected with said fabric segment in the area of said opening formed in said pocket, said length of elastic providing said pocket with at least part of its memory and allowing the size of the opening in said pocket to be resiliently deformed during transformation of said figure from one configuration to another.

12. A toy figure as defined in claim 11 wherein said body portion comprises a mass of compliant fill material with a compliant fabric cover thereover.

13. A toy figure as defined in claim 12 wherein the fanciful material includes facial material connected with the body portion, at least part of said facial material being visible in all configurations of said toy figure.

14. A toy figure as defined in claim 13 wherein said fanciful material comprises appendages integral with said body portion, said pocket covering a selected part of said body portion and its appendages when said figure is in its ball-like form, the memory of the pocket enabling the pocket to hold the figure in its ball-like form.

15. A toy figure as defined in any of claims 10–14 wherein said fabric segment comprises a segment of resiliently deformable fiber material secured to said body portion.

16. A toy figure as defined in claim 2 wherein a partially tensioned length of elastic is connected with said fabric segment in the area of said opening in said pocket, said partially tensioned length of elastic providing the opening of said pocket with a memory causing the opening in said pocket to contract toward a predetermined set, and said partially tensioned length of elastic allowing the size of the opening in said pocket to be resiliently deformable during transformation of said figure from one configuration to another.

17. A toy figure as defined in claim 16 wherein the fanciful material includes facial material connected with the body portion, at least part of said facial material being visible in all configurations of said toy figure.

18. A toy figure as defined in claim 17 wherein said body portion comprises a mass of compliant fill material with a compliant fabric cover thereover.

19. A toy figure as defined in claim 18, wherein said fanciful material comprises appendages integral with said body portion, said fabric segment being resiliently expandable to enable the pocket to cover a selected part of said body portion and its appendages and to give the figure a ball-like form when said figure is in its second configuration, the memory of the fabric segment enabling the fabric segment to hold the figure in its ball-like form.

20. A toy figure as defined in any of claims 16–19 wherein said fabric segment comprises a segment of resiliently deformable fiber material secured to said main body portion.

21. A toy figure as defined in claim 2 wherein said fanciful material and said pocket are disposed at different locations on said body portion when said figure is in said first configuration, and said pocket covers a selected portion of said body portion and its fanciful material and biases the figure to a ball-like form when said figure is in said second configuration.

22. A toy figure as defined in claim 21 wherein a partially tensioned length of elastic is connected with said fabric segment in the area of said opening in said pocket, said partially tensioned length of elastic providing said pocket with at least part of its memory and allowing the size of the opening in said pocket to be resiliently deformed during transformation of said figure from one configuration to another.

23. A toy figure as defined in claim 22 wherein said body portion comprises a mass of compliant fill material with a compliant fabric cover thereover.

24. A toy figure as defined in claim 23 wherein said fanciful material includes facial material connected with the body portion, at least part of said facial material being visible in all configurations of said toy figure.

25. A toy figure as defined in claim 24 wherein said fanciful material comprises appendages integral with said body portion, said pocket covering a selected part of said body portion and its appendages when said figure is in its ball-like form, the memory of the pocket enabling the pocket to hold the figure in its ball-like form.

26. A toy figure as defined in any of claims 21–25 wherein said fabric segment comprises a segment of resiliently deformable fiber material secured to said main body portion.

* * * * *